US010640845B2

(12) United States Patent
Yang et al.

(10) Patent No.: US 10,640,845 B2
(45) **Date of Patent: *May 5, 2020**

(54) HIGH-PRESSURE LIQUID-STATE OR SUPERCRITICAL-STATE QUENCHING APPARATUS

(71) Applicant: Shanghai Yibai Industrial Furnaces Co., Ltd., Shanghai (CN)

(72) Inventors: Jingfeng Yang, Dafeng (CN); Peng Shen, Anqing (CN); Fan Yang, Shanghai (CN)

(73) Assignee: Shanghai Yibai Industrial Furnaces Co., Ltd., Shanghai (CN)

( * ) Notice: Subject to any disclaimer, the term of this patent is extended or adjusted under 35 U.S.C. 154(b) by 236 days.

This patent is subject to a terminal disclaimer.

(21) Appl. No.: 15/858,938

(22) Filed: Dec. 29, 2017

(65) Prior Publication Data

US 2018/0187284 A1 Jul. 5, 2018

(30) Foreign Application Priority Data

Dec. 30, 2016 (CN) ..... 2016 1 1258744

(51) Int. Cl.

| | |
|---|---|
| ***C21D 1/62*** | (2006.01) |
| ***C21D 11/00*** | (2006.01) |
| ***C21D 1/613*** | (2006.01) |
| ***F27B 5/16*** | (2006.01) |
| ***F27B 5/18*** | (2006.01) |
| ***C21D 1/773*** | (2006.01) |
| ***F27B 5/04*** | (2006.01) |
| ***C22F 1/00*** | (2006.01) |
| *F27D 9/00* | (2006.01) |

(52) U.S. Cl.

CPC ..... *C21D 11/005* (2013.01); *C21D 1/613* (2013.01); *C21D 1/62* (2013.01); *C21D 1/773* (2013.01); *C22F 1/002* (2013.01); *F27B 5/04* (2013.01); *F27B 5/16* (2013.01); *F27B 5/18* (2013.01); *F27D 2009/0072* (2013.01)

(58) Field of Classification Search

CPC ..... C21D 1/76; C21D 1/773

See application file for complete search history.

(56) References Cited

U.S. PATENT DOCUMENTS

| | | | | |
|---|---|---|---|---|
| 2007/0068606 | A1* | 3/2007 | Schmetz | C21D 1/74 148/633 |
| 2009/0032982 | A1* | 2/2009 | Giacobbe | C21D 1/76 261/128 |
| 2016/0102377 | A1* | 4/2016 | Fujak | C21D 1/773 266/250 |
| 2018/0185890 | A1* | 7/2018 | Yang | B08B 7/0021 |
| 2018/0187284 | A1* | 7/2018 | Yang | C21D 1/773 |

* cited by examiner

*Primary Examiner* — Scott R Kastler

(74) *Attorney, Agent, or Firm* — Muncy, Geissler, Olds & Lowe, P.C.

(57) ABSTRACT

Disclosed are a high-pressure liquid-state or supercritical-state quenching apparatus, comprising a working chamber, a heating device, a cooling device, a vacuum pump set, a storage tank, a buffer tank, a gas booster, a first pressure gauge, and a temperature controller. According to the Invention, vacuum liquid-state or supercritical-state quenching is implemented, which satisfies a quenching requirement of a large workpiece, and can also achieve an effect of high-pressure gas quenching. In addition, clean heat treatment is implemented, which avoids waste gas and waste water pollution, and is energy-saving and environmentally-friendly heat treatment.

10 Claims, 1 Drawing Sheet

HIGH-PRESSURE LIQUID-STATE OR SUPERCRITICAL-STATE QUENCHING APPARATUS

FIELD OF THE INVENTION

The Invention relates to the field of vacuum heat treatment technologies, and in particular, to a high-pressure liquid-state or supercritical-state quenching apparatus.

BACKGROUND OF THE INVENTION

Only two methods are available for an existing vacuum device to complete quenching. One is high-pressure gas quenching after heating, and the other is oil quenching at atmospheric or low pressure in a quenching chamber after heating.

The high-pressure gas quenching has advantages of reducing heat-treatment deformation of a part and avoiding pollution caused by oil quenching of a workpiece (the workpiece does not need to be cleaned after gas quenching), which is an oxidation-free and pollution-free heat treatment technology. However, it also has a significant disadvantage: Gas is used as a cooling medium, and has very limited thermal conductivity that is much lower than the thermal conductivity of a liquid. Therefore, to ensure the heat treatment effect of high-pressure gas quenching, only a small workpiece or a thin workpiece can be treated.

Liquid quenching has a good cooling speed, and basically can satisfy quenching processes of various workpieces. However, quenching deformation, cracking, and other heat treatment defects cannot be avoided, and steam produced during quenching pollutes a heating chamber to some extent, making it difficult to reach a vacuum degree that needs to be set. Therefore, the heating chamber and a workpiece transfer platform need to be cleaned regularly.

SUMMARY OF THE INVENTION

The objective of the Invention is to provide a high-pressure liquid-state or supercritical-state quenching apparatus to overcome the defect in the prior art. Vacuum liquid-state or supercritical-state quenching is implemented, which satisfies a quenching requirement of a large workpiece, and can also achieve an effect of high-pressure gas quenching. In addition, clean heat treatment is implemented, which avoids waste gas and waste water pollution, and is energy-saving and environmentally-friendly heat treatment.

The objective of the Invention may be achieved by using the following technical solutions:

A high-pressure liquid-state or supercritical-state quenching apparatus comprises:

a working chamber, internally provided with a heating device and a cooling device, and connected to a vacuum pump set;

a storage tank, provided with a liquid carbon dioxide supply port, and connected to a liquid carbon dioxide inlet of the working chamber;

a buffer tank, separately connected to the working chamber and the storage tank through a pressurization loop, and further separately connected to the working chamber and the storage tank through a circulation loop;

a gas booster, disposed at a gas outlet of the buffer tank;

a first pressure gauge, disposed on the working chamber; and a temperature controller, disposed on the working chamber, and separately connected to the heating device and the cooling device.

The apparatus further comprises a second pressure gauge disposed on the buffer tank and a third pressure gauge disposed on the storage tank.

The apparatus further comprises an integrated controller, and the integrated controller is separately connected to the vacuum pump set, the gas booster, the first pressure gauge, and the temperature controller.

The integrated controller is a PLC controller.

The integrated controller is wirelessly connected to a host computer equipped with a display screen.

A liquid crystal display screen for displaying a working status is disposed on the working chamber, and the liquid crystal display screen is connected to the integrated controller.

The apparatus further comprises a plurality of control valves, and the plurality of control valves is respectively correspondingly disposed on the pressurization loop and the circulation loop and at the liquid carbon dioxide inlet.

A gas filter is disposed in the buffer tank.

A pressure relief pipe is further disposed between the working chamber and the buffer tank, and a flow regulation valve is disposed on the pressure relief pipe.

During high-pressure liquid-state or supercritical-state quenching, liquid carbon dioxide in the storage tank enters the working chamber that is heated, to quench a target workpiece, and a status of carbon dioxide in the working chamber is controlled according to a set pressure-temperature relationship curve during quenching, wherein during liquid-state and supercritical-state quenching, when pressure in the working chamber is lower than a set range, the pressurization loop is turned on and the gas booster is operated; and when the pressure in the working chamber is higher than the set range, the pressure relief pipe is opened to transfer discharged carbon dioxide to the buffer tank.

Compared with the prior art, the Invention has the following advantages:

1. As liquid-state or supercritical-state carbon dioxide is used as a quenching medium to quench a workpiece, a desirable quenching effect is achieved, and the workpiece does not have cracking, deformation, and other heat treatment defects.

2. Liquid-state or supercritical-state $CO_2$ quenching is mainly to control the pressure and temperature in a working chamber. As a pressure gauge and a temperature controller are disposed to coordinate with work of a pressurization loop and a circulation loop that are separated, when the pressure in the working chamber is lower than a set pressure range, the pressure is increased by using a buffer tank and a gas booster on the pressurization loop; and when the pressure in the working chamber is higher than the set pressure range, the carbon dioxide in the working chamber is discharged through a control valve. In this way, the pressure and temperature in the working chamber are regulated in real time. A cooling device is mounted at a rear end of the working chamber to coordinate with the temperature controller, thereby ensuring that the liquid carbon dioxide in the working chamber is within a set temperature range.

3. The apparatus is not affected by the size of a target workpiece, can satisfy different workpiece requirements, is easy to promote and use, and is very practical.

4. Liquid-state and supercritical-state quenching can be selected by controlling the pressure in the working chamber, and supercritical $CO_2$ also has an effect of cleaning a workpiece. In addition, the quenched workpiece does not need to be cleaned, and the working chamber is not polluted.

5. $CO_2$ is safe, non-toxic, pollution-free, recyclable, and easy to obtain, which reduces costs for users.

6. The working chamber is connected to a vacuum pump set for vacuumization to completely remove air introduced when a workpiece enters the working chamber, thereby preventing mixing of $CO_2$ and air and preventing the quenching medium from being polluted, and also ensuring that the workpiece is heated in vacuum, no oxidation is caused, and a heating speed is fast. After the workpiece is heated in the vacuum working chamber, the heating device is turned off, and liquid carbon dioxide is quickly transferred to the working chamber. The liquid carbon dioxide coordinates with the cooling device at the rear end of the working chamber for cooling, thereby implementing liquid-state or supercritical-state quenching of the workpiece.

7. The buffer tank is disposed. After quenching ends, $CO_2$ in the working chamber is discharged to the buffer tank, the pressure in the buffer tank is controlled, and finally gaseous $CO_2$ is transferred to the storage tank through the gas booster on the circulation loop for a next cycle of work.

8. An integrated controller and the control valve are disposed for automated control, which improve the working efficiency and control precision, and coordinate with a host computer and a liquid crystal display screen, making it easy for an operator to observe all working statuses of devices in real time, and achieving desirable visibility.

9. A pressure relief pipe is additionally disposed. With a flow regulation valve, the pressure in the working chamber can be reduced accurately, which overcomes the defect of inaccurate pressure regulation in the working chamber caused by unregulated pressure relief on the circulation loop.

In the Figures: 1: vacuum pump set, 2: first control valve, 3: cooling device, 4: first pressure gauge, 5: temperature controller, 6: working chamber, 7: target workpiece, 8: heating device, 9: second control valve, 10: third control valve, 11: fourth control valve, 12: fifth control valve, 13: sixth control valve, 14: second pressure gauge, 15: buffer tank, 16: gas booster, 17: storage tank, 18: third pressure gauge, 19: seventh control valve, 20: eighth control valve, 21: liquid carbon dioxide supply port, 22: first pipe, 23: second pipe, 24: third pipe, 25: fourth pipe, and 26: pressure relief pipe.

DETAILED DESCRIPTION OF THE INVENTION

The Invention is described in detail below with reference to the accompanying drawings and specific embodiments. The embodiments are implemented based on the technical solutions of the Invention, and detailed implementations and specific operating processes are given, but the protection scope of the Invention is not limited to the following embodiments.

Figure 1:
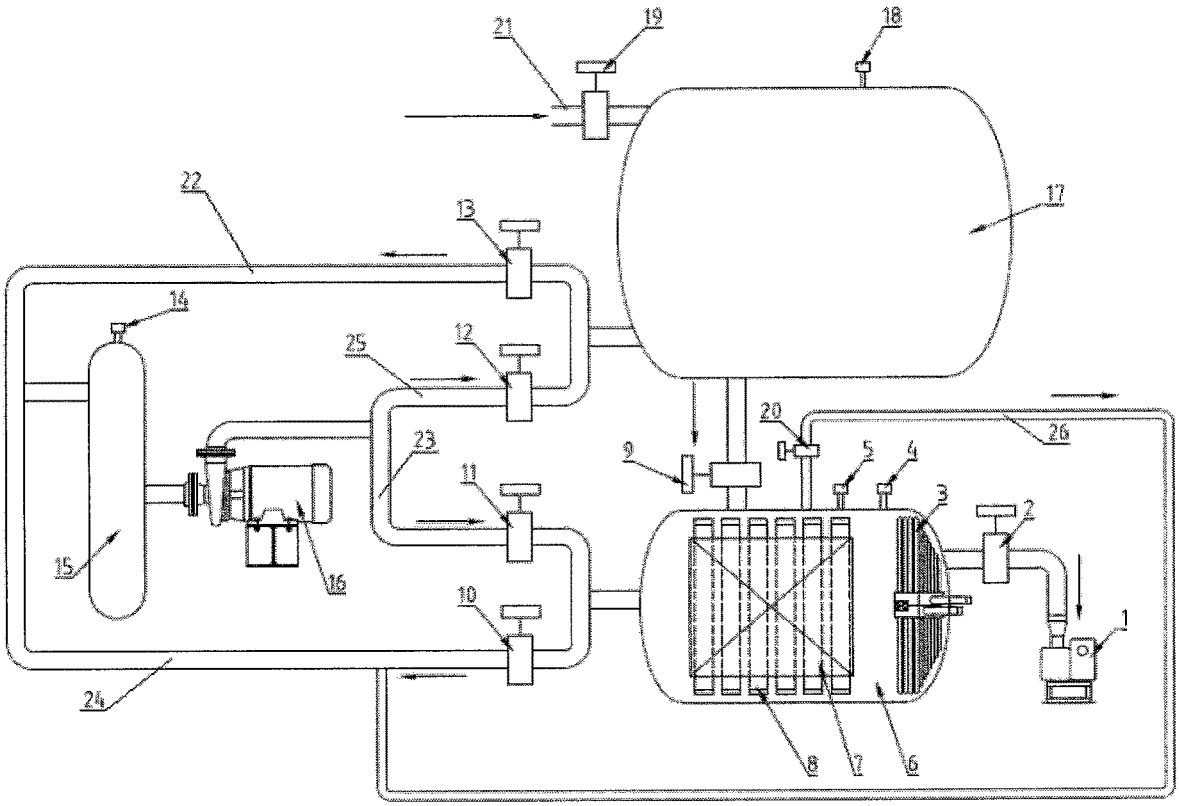
FIG. 1 is a schematic diagram of an overall structure of the Invention.

As shown in FIG. 1, a high-pressure liquid-state or supercritical-state quenching apparatus comprises a working chamber 6, a vacuum pump set 1, a storage tank 17, a buffer tank 15, a gas booster 16, a pressurization loop, a circulation loop, a plurality of control valves, and a plurality of pressure gauges. A plurality of evenly arranged heating devices 8 and cooling devices 3 are disposed in the working chamber 6. A temperature controller 5 and a first pressure gauge 4 are disposed on the working chamber 6. The temperature controller 5 is separately connected to the heating devices 8 and the cooling devices 3. The vacuum pump set 1 is connected to the working chamber 6 through a first control valve 2. The storage tank 17 is provided with a liquid carbon dioxide supply port 21 having a seventh control valve 19, and is connected to a liquid carbon dioxide inlet of the working chamber 6 through a pipe having a second control valve 9. The buffer tank 15 is separately connected to the working chamber 6 and the storage tank 17 through the pressurization loop, and further separately connected to the working chamber 6 and the storage tank 17 through the circulation loop. The pressurization loop comprises a first pipe 22 having a sixth control valve 13 and a second pipe 23 having a fourth control valve 11. The circulation pipe comprises a third pipe 24 having a third control valve 10 and a fourth pipe 25 having a fifth control valve 12. The gas booster 16 is disposed at a gas outlet of the buffer tank 15. A second pressure gauge 14 is disposed on the buffer tank 15. A third pressure gauge 18 is disposed on the storage tank 17. A pressure relief pipe 26 is further disposed between the working chamber 6 and the buffer tank 15. An eighth control valve 20 is disposed on the pressure relief pipe 26, and the eighth control valve 20 is a flow regulation valve.

In the apparatus of the Invention, $CO_2$ is selected as a quenching medium, as $CO_2$ exists in nature and is safe, not flammable and explosive, non-toxic, and non-corrosive, and it is easy to implement a liquid-state or supercritical-state state of $CO_2$. In addition, because $CO_2$ is gaseous at atmospheric pressure, after discharge, there is no gas or liquid element but residual $CO_2$ in the working chamber 6, which does not pollute air or remain on a workpiece. Moreover, $CO_2$ after quenching is recycled and reused, which saves energy resources, and can also achieve an optimal quenching effect, thereby bringing economic benefits to users.

During high-pressure liquid-state or supercritical-state quenching, liquid carbon dioxide in the storage tank 17 enters the working chamber 6 that is heated, to quench a target workpiece 7, and a status of carbon dioxide in the working chamber 6 is controlled according to a set pressure-temperature relationship curve during quenching, wherein during liquid-state and supercritical-state quenching, when pressure in the working chamber 6 is lower than a set range, the pressurization loop is turned on and the gas booster 16 is operated; and when the pressure in the working chamber 6 is higher than the set range, the pressure relief pipe 26 is opened to transfer discharged carbon dioxide to the buffer tank 15.

Figure 2:
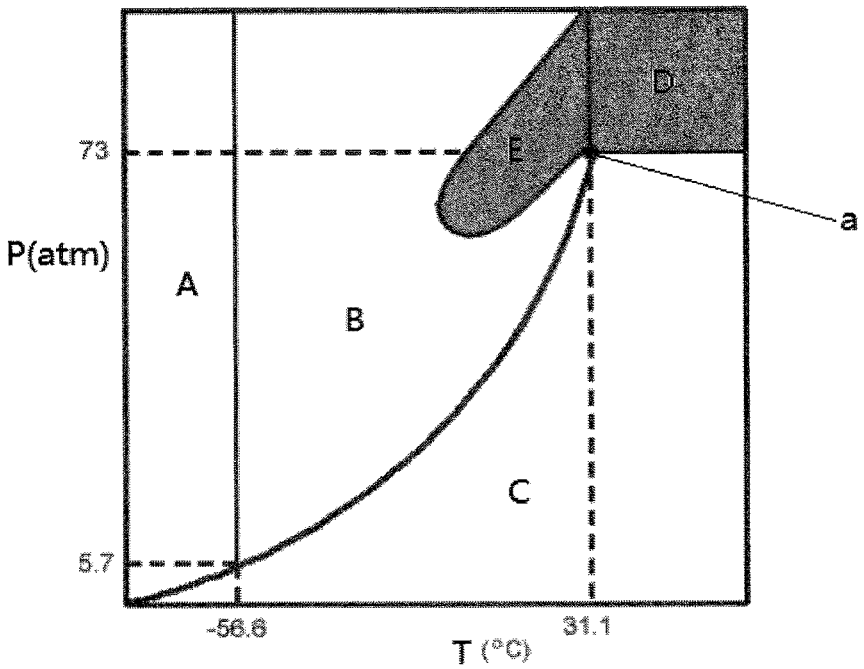
FIG. 2 is a schematic diagram of a set pressure-temperature relationship curve in the Invention.

The set pressure-temperature relationship curve is shown in FIG. 2. The pressure-temperature relationship curve is a quadratic function curve. In FIG. 2, A is a solid-state region, B is a liquid-state region, C is a gaseous-state region, D is a supercritical-state region, E is a secondary supercritical-state region, and a is a critical point.

It can be seen from FIG. 2 that, $CO_2$ is supercritical when the temperature is higher than 31.1° C. and the pressure is greater than 73 bar; and is liquid when the temperature is higher than −56.6° C. and the pressure is greater than 5.7 bar. Laboratory data shows that $CO_2$ can be liquefied at 20° C. when the pressure reaches 57 bar. In the Invention, such a feature of $CO_2$ is used to implement high-pressure liquid-state or supercritical-state quenching.

The apparatus further comprises an integrated controller, and the integrated controller is separately connected to the vacuum pump set 1, the gas booster 16, the first pressure gauge 4, and the temperature controller 5. The integrated controller is a PLC controller, and is wirelessly connected to a host computer equipped with a display screen, to implement functions of automatic monitoring and centralized control.

A liquid crystal display screen for displaying a working status is disposed on the working chamber 6, and the liquid crystal display screen is connected to the integrated controller.

A gas filter is disposed in the buffer tank 15, which can filter out impurities for recycled $CO_2$, to ensure the cleanliness of $CO_2$.

A working process of vacuum high-pressure liquid-state or supercritical-state quenching is as follows:

First, the target workpiece 7 is placed in the working chamber 6, and then the first control valve 2 and the vacuum pump set 1 are started to vacuumize the working chamber 6, to eliminate air introduced by the target workpiece 7, perform heating in vacuum, and ensure the cleanliness of $CO_2$. When the first pressure gauge 4 detects that a vacuum degree in the working chamber 6 satisfies a set requirement, the first control valve 2 and vacuum pump set 1 are turned off. The heating device 8 is started to heat the target workpiece 7, and the temperature in the working chamber 6 is controlled within a set range by using the temperature controller 5.

After heating, the heating device 8 is turned off, and the second control valve 9 is turned on, so that liquid carbon dioxide is quickly supplemented in the working chamber 6 to complete quenching. When the first pressure gauge 4 detects that the pressure is lower than the set range, the fourth control valve 11, the sixth control valve 13, and the gas booster 16 are turned on; when the first pressure gauge 4 detects that the pressure is higher than the set range, the eighth control valve 20 is automatically turned on to transfer discharged $CO_2$ to the buffer tank 15 for recycling and reuse. During quenching, a status of $CO_2$ in the working chamber 6 can be controlled according to a process requirement by using the first pressure gauge 4, to implement liquid-state and supercritical-state quenching.

After quenching ends, the third control valve 10, the fifth control valve 12, and the gas booster 16 are turned on to transfer $CO_2$ in the working chamber 6 to the storage tank 17 via the buffer tank 15, to complete the quenching process. The pressure in the storage tank 17 is controlled by using the third pressure gauge 18, so that $CO_2$ is liquid in the storage tank 17.

$CO_2$ in the buffer tank 15 is controlled to be gaseous by using the second pressure gauge 14, to ensure that the gas booster 16 can operate normally. To compensate for loss of $CO_2$ during use, supply to the storage tank 17 can be completed regularly by using the seventh control valve 19.

The invention claimed is:

1. A high-pressure liquid-state or supercritical-state quenching apparatus, comprising:

a working chamber, internally provided with a heating device and a cooling device, and connected to a vacuum pump set;

a storage tank, provided with a liquid carbon dioxide supply port, and connected to a liquid carbon dioxide inlet of the working chamber;

a buffer tank, separately connected to the working chamber and the storage tank through a pressurization loop, and further separately connected to the working chamber and the storage tank through a circulation loop;

a gas booster, disposed at a gas outlet of the buffer tank;

a first pressure gauge, disposed on the working chamber; and a temperature controller, disposed on the working chamber, and separately connected to the heating device and the cooling device.

2. The high-pressure liquid-state or supercritical-state quenching apparatus according to claim 1, wherein the apparatus further comprises a second pressure gauge disposed on the buffer tank and a third pressure gauge disposed on the storage tank.

3. The high-pressure liquid-state or supercritical-state quenching apparatus according to claim 1, wherein the apparatus further comprises an integrated controller, and the integrated controller is separately connected to the vacuum pump set, the gas booster, the first pressure gauge, and the temperature controller.

4. The high-pressure liquid-state or supercritical-state quenching apparatus according to claim 3, wherein the integrated controller is a PLC controller.

5. The high-pressure liquid-state or supercritical-state quenching apparatus according to claim 3, wherein the integrated controller is wirelessly connected to a host computer equipped with a display screen.

6. The high-pressure liquid-state or supercritical-state quenching apparatus according to claim 3, wherein a liquid crystal display screen for displaying a working status is disposed on the working chamber, and the liquid crystal display screen is connected to the integrated controller.

7. The high-pressure liquid-state or supercritical-state quenching apparatus according to claim 1, wherein the apparatus further comprises a plurality of control valves, and the plurality of control valves is respectively correspondingly disposed on the pressurization loop and the circulation loop and at the liquid carbon dioxide inlet.

8. The high-pressure liquid-state or supercritical-state quenching apparatus according to claim 1, wherein a gas filter is disposed in the buffer tank.

9. The high-pressure liquid-state or supercritical-state quenching apparatus according to claim 1, wherein a pressure relief pipe is further disposed between the working chamber and the buffer tank, and a flow regulation valve is disposed on the pressure relief pipe.

10. The high-pressure liquid-state or supercritical-state quenching apparatus according to claim 9, wherein during high-pressure liquid-state or supercritical-state quenching, the storage tank is configured to have liquid carbon dioxide enter the working chamber being heated to quench a target workpiece, and the working chamber is configured to have a status of carbon dioxide in the working chamber to be controlled according to a set pressure-temperature relationship curve during quenching, wherein during liquid-state and supercritical-state quenching, when pressure in the working chamber is lower than a set range, the pressurization loop is configured to be turned on and the gas booster is operated; and when the pressure in the working chamber is higher than the set range, the pressure relief pipe is configured to be opened to transfer discharged carbon dioxide to the buffer tank.

* * * * *